United States Patent [19]

Kohyama

[11] Patent Number: 4,515,106

[45] Date of Patent: May 7, 1985

[54] DEVELOPING APPARATUS

[75] Inventor: Mitsuaki Kohyama, Tokyo, Japan

[73] Assignee: Tokyo Shibaura Denki Kabushiki Kaisha, Japan

[21] Appl. No.: 541,657

[22] Filed: Oct. 13, 1983

[30] Foreign Application Priority Data

Oct. 15, 1982 [JP] Japan ..... 57-180924
Oct. 15, 1982 [JP] Japan ..... 57-180925

[51] Int. Cl.[3] ..... G03G 15/06
[52] U.S. Cl. ..... 118/651
[58] Field of Search ..... 118/651

[56] References Cited

U.S. PATENT DOCUMENTS 4,282,303 8/1981 Bergen ..... 430/120

*Primary Examiner*—Bernard D. Pianalto
*Attorney, Agent, or Firm*—Cushman, Darby & Cushman

[57] ABSTRACT

A developing apparatus according to the present invention is opposed to a photosensitive layer of a photosensitive drum, and supplies the photosensitive layer with a nonmagnetic insulating toner of one component type charged for a predetermined polarity, to develop an electrostatic latent image formed on the photosensitive layer. The developing apparatus is provided with a developing roll which comprises a rotatably cylindrical roll body formed of a dielectric material and hundreds or thousands of linear microelectrodes attached to that surface of the roll body which faces the photosensitive layer, each of the microelectrodes being apart from the adjacent ones and having a surface which faces the photosensitive layer and is exposed, and an electrical power source for impressing at least one pair of adjacent microelectrodes among the plurality of the microelectrodes with a voltage to generate an electric field with a magnitude high enough to fly the toner on one of the pair of electrodes therefrom.

18 Claims, 23 Drawing Figures

FIG. 6
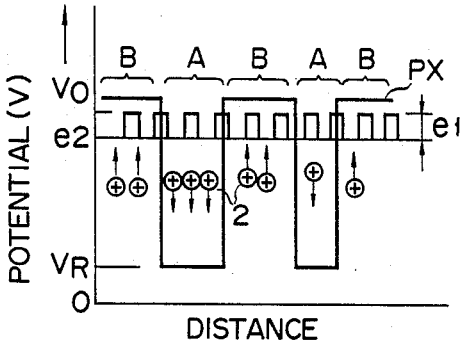
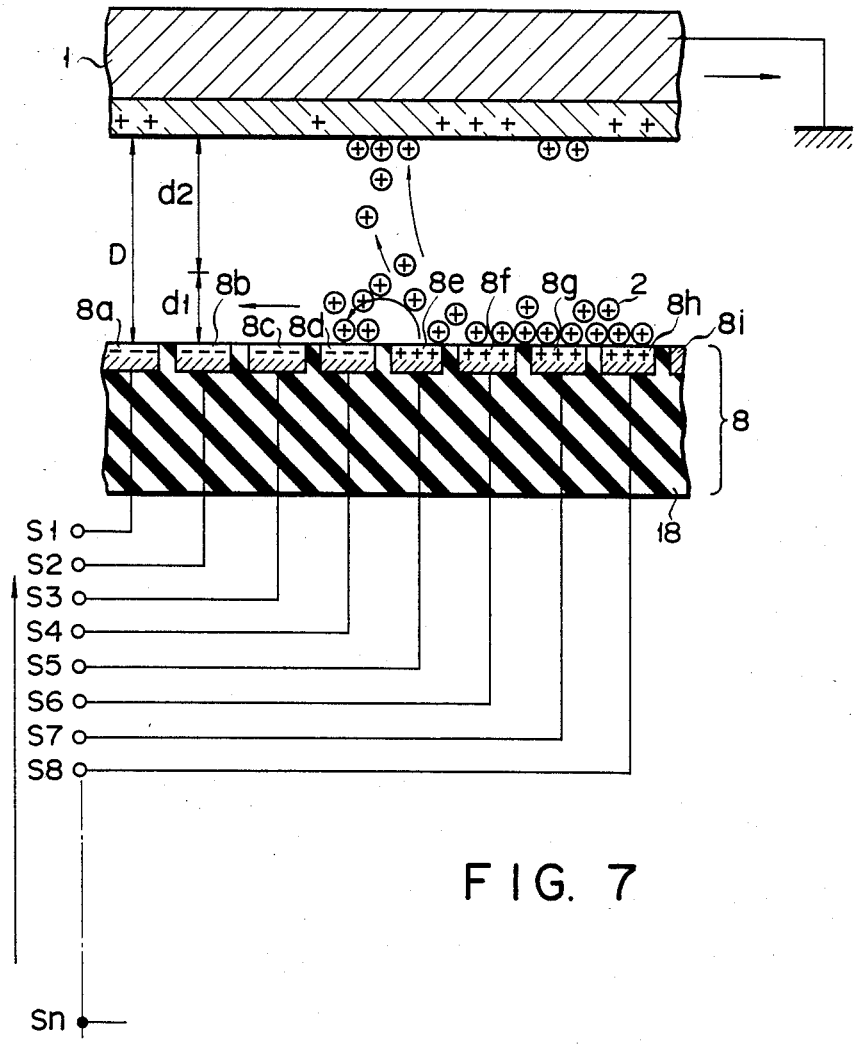
FIG. 7

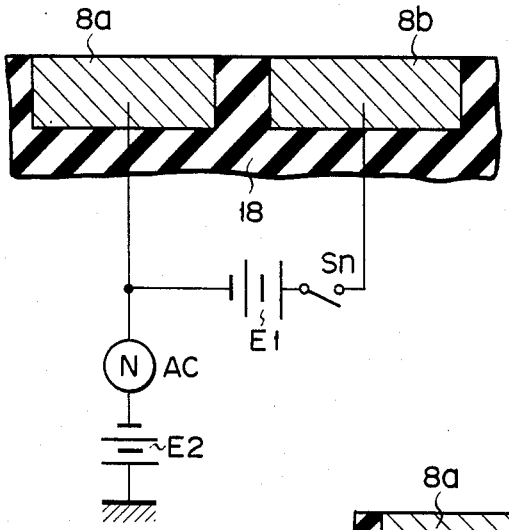
FIG. 11
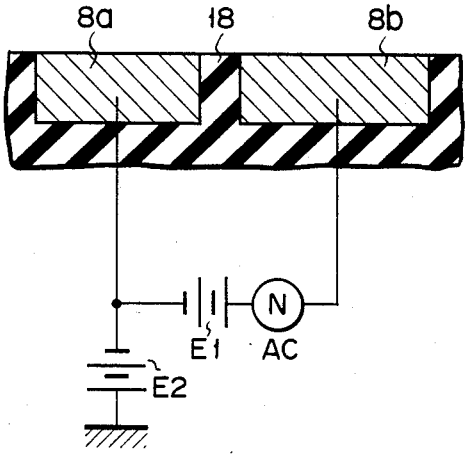
FIG. 12
FIG. 13
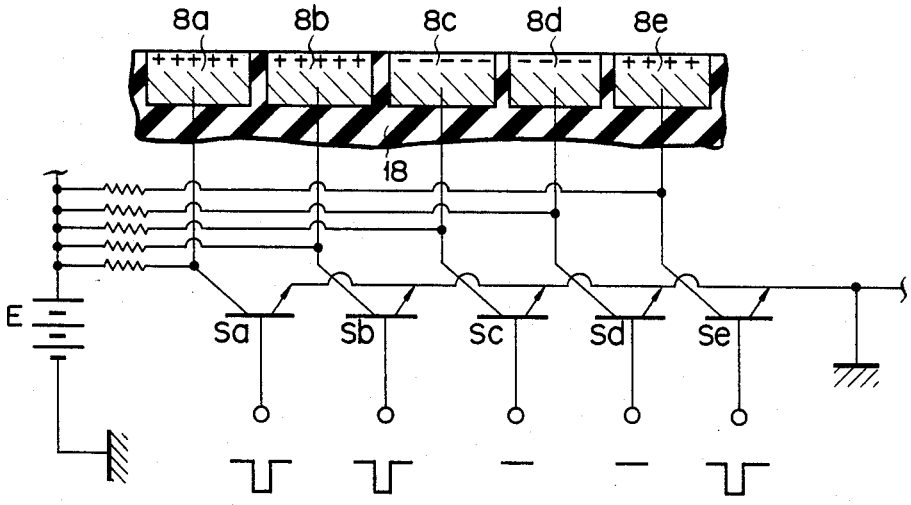

DEVELOPING APPARATUS

BACKGROUND OF THE INVENTION

The present invention relates to a developing apparatus for developing an electrostatic latent image formed on a photosensitive layer into a visible image and, more specifically, to a developing apparatus for developing an electrostatic latent image into visible image, without coming into contact with the photosensitive layer.

Many processes for developing electrostatic latent images are conventionally known, such as the dry development processes including the magnetic brush process, the cascade process, the fur brush process, etc.; the liquid development process using electrophoresis; and various modifications of these processes.

Recently, electrophotographic recording apparatuses of a light beam scanning type, called laser printers or liquid crystal printers, have been developed and are coming into wide use. Many of the electrostatic latent images used in these electrophotographic recording apparatuses are developed by the reversal development process.

The reversal development process is one in which a light beam is applied to the surface of a photosensitive layer, so that only those portions of the photosensitive layer at which electrostatic charges are erased are developed. According to the reversal development process, the area of the regions exposed to the light beam can be relatively small, so that the load of the light source is reduced, and the accuracy required for mechanical beam control lessened.

According to the reverse development process (hereinafter referred to as the non-contact development process), an electrode 3 having a thin layer of a so-called one component type developing agent 2 thereon is opposed to an electrostatic latent image forming surface 1, or a surface to be developed, in an non-contact relationship, as shown in FIG. 1A, and the developing agent 2 is electrostatically flown and attracted to an electrostatic latent image on the latent image forming surface 1, by the agency of an electrical field generated between the electrostatic latent image and the electrode 3, with a bias voltage being applied externally. At present the non-contact developing process not only in the reversal developing device but also in the ordinary developing device (e.g., a copying device) are on trail.

Under the circumstances, however, there is neither means for uniformly charging the developing agent 2 nor effective means for maintaining a predetermined charge amount to selectively fly the developing agent 2 in the non-contact development. Moreover, the electric field required for the flight of the developing agent 2 is too large. Therefore, the latent image requires a potential of about 1,000 V even through the gap D between the latent image forming surface 1 and the electrode 3 is narrowed to, for example, 150 microns. Photosensitive materials to resist the voltage of 1,000 V are limited in number. Even if an external bias voltage is applied in order to reduce the strength of the aforesaid potential, arc discharge will be caused between the electrode 3 and the latent image forming surface 1 to damage some parts of the apparatus, since the electrode 3 is in close vicinity to the latent image forming surface 1. Further, the developing agent 2 is charged unevenly, so that fog or streaks may be caused. These problems are left unsettled.

For keeping the charges on the developing agent 2, a toner may be separated from a two-component developing agent. According to this method, however, arc discharge is more liable to be caused if a carrier is mixed in the toner in the developing process, failing to be completely separated. Also, it is to be desired that the non-contact development should be effected by the use of a one-component developing agent containing no carrier.

The primary advantage of the non-contact development process lies in the fact that previously developed images will never be disturbed by superposed development in color electrophotography. For color developing agents to provide various colors, therefore, it is not advisable to use magnetic toners which contain black magnetic powder. Thus, the developing agent used in expected to be a nonmagnetic, one-component developing agent (hereinafter referred to simply as a toner).

In a currently prevalent method for uniform toner charging, the toner is rubbed against a developing roll by means of a rubber blade, or the like, to form a thin layer, when the toner is charged by friction with the developing roll or blade. The efficiency of contact between the toner and the roller or the blade is very low. It is therefore almost impossible to apply uniform charges to the toner forming the toner layer. This is a cause of the production of the defective images.

The theory of the non-contact development will be described in due order. It was revealed that the most dominant force in constraining the toner's flight is a reflected image force Fm produced between the toner and the developing electrode 3. This decision was made after the relationship between the magnitude of an electric field necessary for the toner's flight and the charge amount was examined, using toners of different charge amounts and providing a dielectric layer 3-1 on the developing electrode, as shown in FIG. 1C. If a toner particle with radius r has an electric charge q in the center, as shown in FIG. 1B, then the reflected image force Fm is given by $$Fm = \frac{1}{4\pi\,\epsilon_0} \cdot \frac{q^2}{4r^2},$$

where $\epsilon_0$ is the dielectric constant of a vacuum. As seen from this equation, the reflected image force Fm varies in inverse proportion to the square of the toner particle diameter or of the distance between the toner and the electrode 3. Hereupon, if the force to attract the toner to the electrostatic latent image or the flying force of the toner produced in the gap D of the developing region by an electric field E generated by the electrostatic latent image is $F_D$, we have a relationship $$F_D = qE > Fm = \frac{q^2}{16\pi\,\epsilon_0\,r^2}.$$

This relationship is the flying condition of the toner. The flying force $F_D$ has a maximum to ensure the easiest flight when the toner particle diameter is as great as possible, and when the charge amount takes a value $q = 8\pi\epsilon_0 r^2 E$ based on a conditional expression, $$\frac{dF_D}{dq} = 0,$$

which is obtained by differentiating both sides of the above equation. The charge amount of the toner may be adjusted in some measure by suitably selecting the toner material. As described before, however, it has conventionally been impossible to charge the individual toner particles uniformly.

In view of these circumstances, it may be seen that the developing sensitivity may be improved, or the toner's flight may be facilitated, by keeping the toner away from the electrode 3. As shown in FIG. 1C, for example, the dielectric layer 3-1 of polyester or epoxy resin with a thickness of 10 to 20 microns may be put on the electrode 3. The reflected image force Fm can be drastically reduced by the dielectric layer 3-1. Thus, the toner's flight is taken to be actually improved. The dielectric layer 3-1 cannot, however, avoid frictional charging between itself and the toner. As a result, the uniformity and stability of an image produced will be greatly damaged by the interference of an electrostatic force newly produced between the toner and the dielectric layer 3-1.

SUMMARY OF THE INVENTION

The present invention has been contrived in view of the above, and is intended to provide a developing apparatus which is greatly improved in developing agent flying efficiency, to permit development of an electrostatic latent image at a lower potential, as well as uniform charging of a developing agent for the production of images of higher quality, and which is capable of feeding a nonmagnetic toner without using any mechanical means.

In order to attain the above object, a developing apparatus according to the present invention is so constructed that a voltage is applied for scanning between a plurality of electrodes attached to a developing agent feeder, thereby providing a potential difference between specified electrodes, and a developing agent is flown among these electrodes to form a smoky or cloudy layer.

According to one aspect of the present invention, a developing apparatus is provided, which is opposed to an electrostatic latent image forming surface of an image carrier, and supplies the electrostatic latent image forming surface with a developer charged for a predetermined polarity, to develop an electrostatic latent image formed on the electrostatic latent image forming surface, and which comprises a substrate formed of a dielectric, a plurality of linear electrodes attached to that surface of the substrate which faces the electrostatic latent image forming surface, each of said electrode being apart from the adjacent ones and having a surface which faces the electrostatic latent image forming surface and is exposed, and voltage impressing means for impressing at least one pair of adjacent electrodes among said plurality of electrodes with a voltage to generate an electric field with a magnitude high enough to fly the developer on one of said pair of electrodes therefrom.

BRIEF DESCRIPTION OF THE DRAWINGS

FIG. 6 is a diagram showing the state of FIG. 5 in an electrical mode;

FIG. 7 is an extractive sectional view showing part of a developing roller used in a developing apparatus of a second embodiment according to the invention;

FIG. 11 is a sectional view showing a first modification of the first embodiment;

FIG. 12 is a sectional view showing a second modification of the first embodiment;

FIG. 13 is a circuit diagram specifically showing the switching means of FIG. 7;

DETAILED DESCRIPTION OF THE PREFERRED EMBODIMENTS

A developing apparatus of a first embodiment according to the present invention, which is used in an electronic copying machine, may now be described in detail, with reference to the accompanying drawings of FIGS. 2 to 6.

Figure 1A:
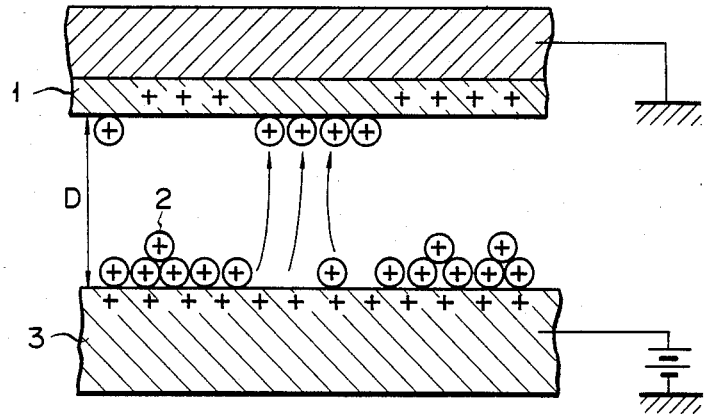
FIG. 1A PRIOR ART
FIGS. 1A to 1C are sectional views illustrating a prior art developing process.
Figure 1B:
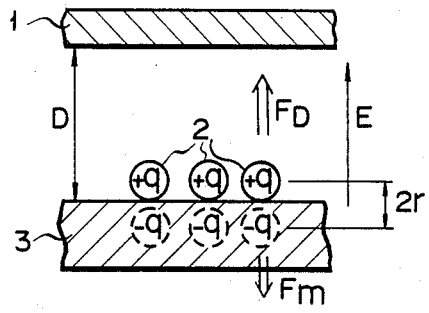
FIG. 1B PRIOR ART
Figure 1C:
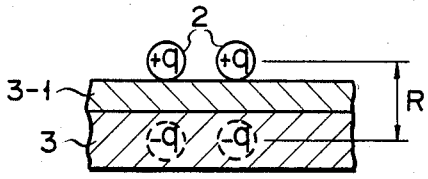
FIG. 1C PRIOR ART
Figure 2:
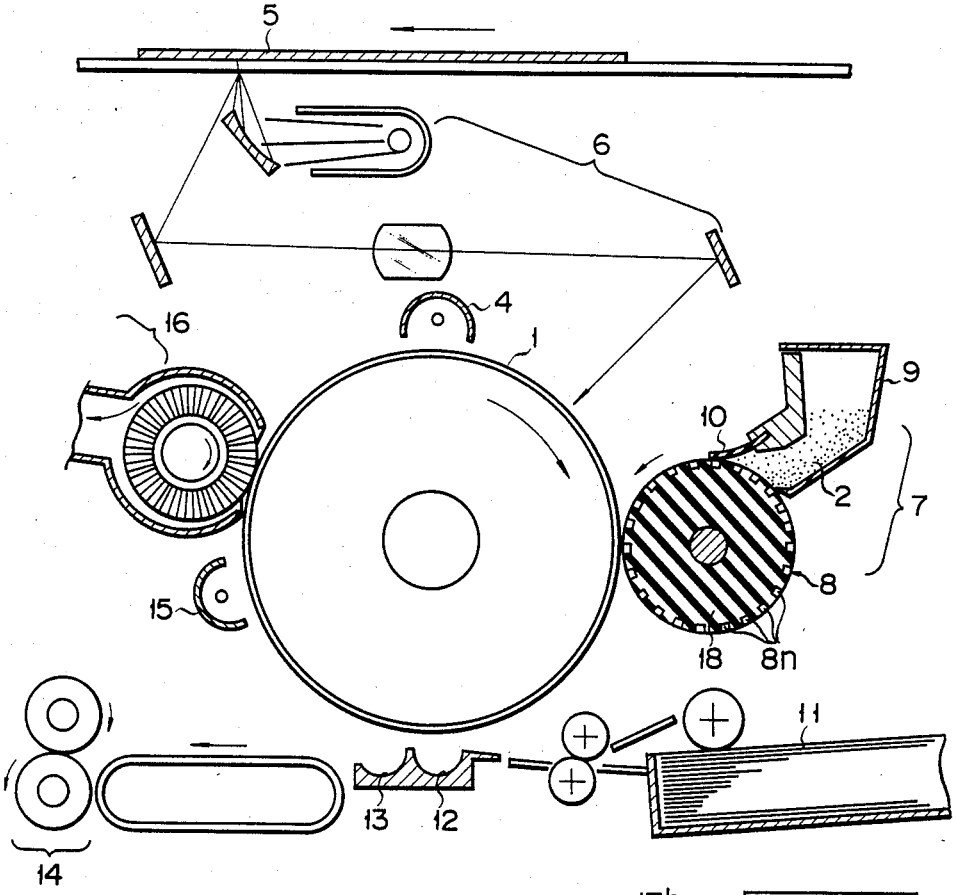
FIG. 2 is a front view schematically showing the arrangement of an electronic copying machine using a developing apparatus of a first embodiment according to the present invention.

FIG. 2 is a sectional view schematically showing the principal part of the electronic copying machine which incorporates the developing apparatus of the first embodiment.

A photosensitive drum 1 (hereinafter referred to as, simply, a drum) is so disposed in the electronic copying machine as to be rotatable in the clockwise direction of FIG. 2. The drum 1 has on its outer peripheral surface a photosensitive layer which is formed of an inorganic photosensitive material such as amorphous selenium, silicon or selenium-tellurium, a resin-dispersed photosensitive material such as zinc oxide or cadmium, sulfide, or various organic photosensitive materials. The drum 1 is uniformly charged with electricity at a surface potential of about 500 to 800 V by a corona charger 4. Then, a reflected light beam from an original 5 is projected on the drum 1 by an optical system 6 to form an electrostatic latent image on the photosensitive layer. The electrostatic latent image is developed by a developing device 7 of one embodiment according to the invention as described in detail later. The developed toner image is transferred by a transfer corona 12 to the surface of a transfer paper which is fed from a paper cassette 11. After the transfer, the transfer paper is separated from the drum 1 by a separation corona 13. Thereupon, the toner image is put unfixed on the separated transfer paper. The unfixed toner image is thermally fixed to the transfer paper by a fixing heat roller unit 14. The fixed transfer paper is issued from the copying machine to be used as a copy. Residual toner on the drum 1 is de-electrified by a de-electrification corona 15, so that its force of adhesion to the drum 1 is reduced. Then, the residual toner is removed by a furbrush cleaner 16 (part of which is not shown). Thus, the drum 1 is restored for another cycle of operation.

The present invention may be applied to the developing apparatuses of various image recording devices which use an electrostatic latent image, as well as to the conventional electronic copying machine described above.

The developing apparatus 7 may now be described in greater detail.

As shown in FIG. 2, the developing apparatus 7 comprises a rotatable developing roll 8 which serves as a toner feeder; a hopper 9 containing therein an insulating nonmagnetic toner 2 of an one-component type and adapted to supply the toner 2 to the developing roll 8; an elastic blade 10 of a rubber material consisting of urethane, styrene-butadiene, silicon, etc., which is adapted to maintain the substantially fixed thickness of the toner 2 applied to the surface of the developing roll 8; and a drive mechanism 19 for rotating the developing roll 8. The elastic blade 10 abuts against the developing roll 8 in a parallel relationship.

Figure 3:
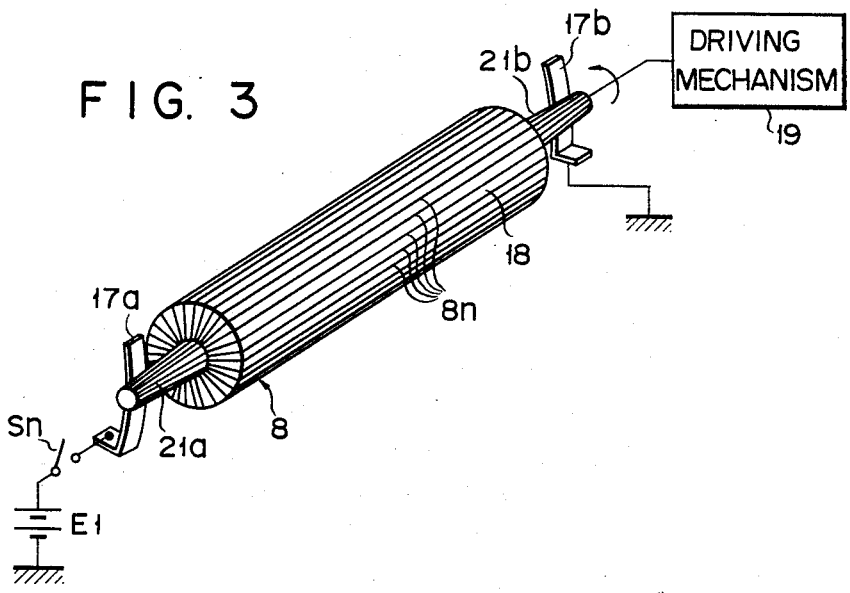
FIG. 3 is an extractive perspective view of a developing roller used in the developing apparatus shown in FIG. 2.

As shown in FIG. 3, the developing roll 8 comprises a rotatable cylindrical roll body 18 formed of a dielectric material; the shaft portions 21*a*, 21*b* of a dielectric material coaxially and individually attached to both end faces of the roll body 18; and hundreds or thousands of linear microelectrodes $8_1$, $8_2$, . . . 8n (hereinafter represented as 8n) which are continuous with the outer peripheral surface and both end faces of the roll body 18, and the outer peripheral surfaces of the shaft portions 21*a*, 21*b*, and are buried in the roll body 18 in such a way as to have exposed surfaces.

The microelectrodes 8n are arranged parallel to the axis of the roll body 18, spaced or isolated from one another.

A first electrode blade 17*a* for voltage supply is so disposed on the drum side of the one shaft portion 21*a* as to be in contact with a specified microelectrode 8*a* at the shaft portion 21*a*. Also, a second electrode blade 17*b* is so disposed on the drum side of the other shaft portion 21*b* as to be in contact with a microelectrode 8*b* which adjoins the specified microelectrode 8*a* at the shaft portion 21*b*. The first electrode blade 17*a* is grounded through a DC power source E1 and a switch Sn, while the second electrode blade 17*b* is grounded directly.

The developing apparatus 7 of the present invention is of the similar construction as the conventional developing means, except that the developing roll 8 has microelectrodes 8n, which produce substantial effects. The direct function of the group of microelectrodes 8n is to cause the toner 2 to take a small flight over the developing roll 8. This function will be described later.

Figure 4A:
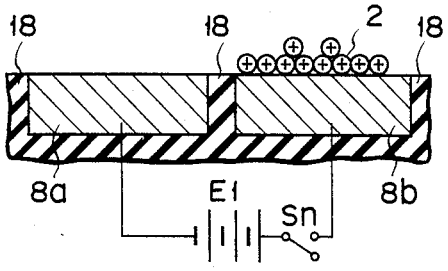
FIGS. 4A to 4C are sectional views illustrating the flight of a toner achieved by the invention.
Figure 4B:
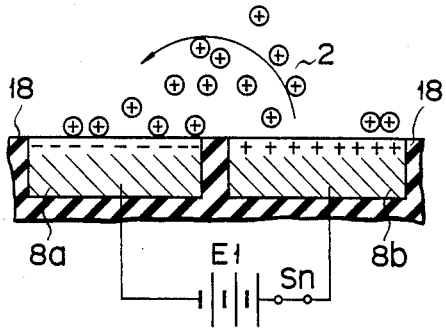
Figure 4C:
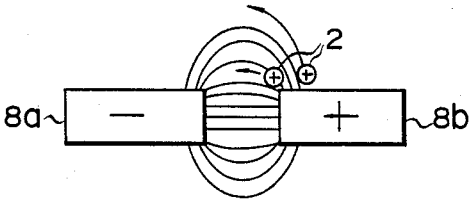

FIGS. 4A and 4B are enlarged views showing the way each two adjacent microelectrodes 8*a*, 8*b* out of the microelectrode group 8n are isolated by a dielectric member 18. When the switch Sn is open, as shown in FIG. 4A, external bias voltage e1 from the DC power source E1 is not applied to the toner 2 (supposed to be positive in polarity in this case) on the microelectrode 8*b*. The moment the switch Sn is closed, as shown in FIG. 4B, microelectrode 8*b* is positively charged, receiving the external bias voltage e1, and the microelectrode 8*a* is negatively charged. Accordingly, the toner 2 of positive polarity is repelled by the microelectrode 8*b* and attracted by the microelectrode 8*a*. Thus, the toner 2 moves flying along a line of electric force between the microelectrodes 8*a* and 8*b*, as indicated by an arrow of FIG. 4C. The conditions of the flight vary with the shape of an electric field generated between the microelectrodes according to the distance between them, the magnitude of voltage applied between the microelectrodes, and the amount of electric charges on the toner 2. A satisfactory flight of the toner 2 was observed under the condition that the distance between the microelectrodes is 200 microns; amount of toner charges, 5 $\mu c/g$; average toner particle diameter, 13 microns; and bias voltage, 200 to 500 V or more.

Figure 5:
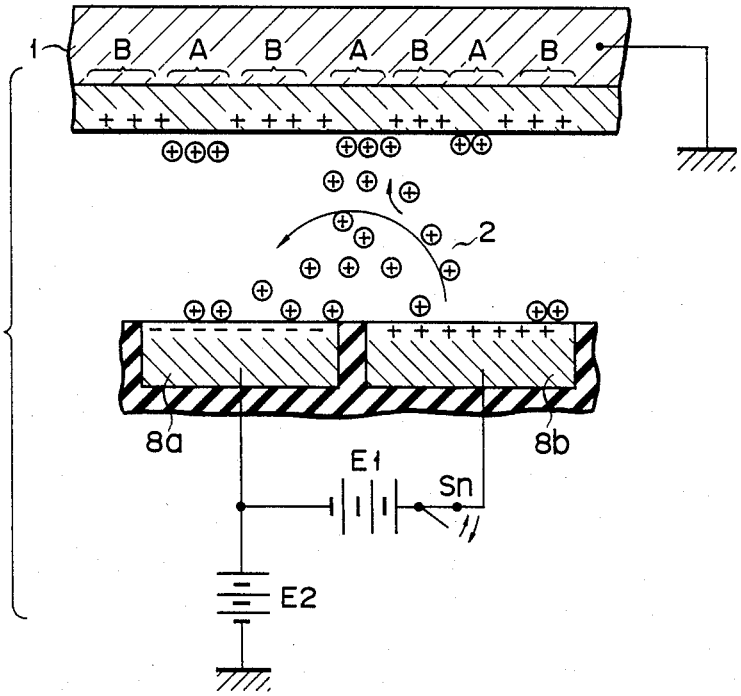
FIG. 5 is a sectional view illustrating the way the flown toner is attracted to a photosensitive layer.

The drum 1 is so charged as to have its surface potential at the $V_O$ level (approx. +1,000V). Those portions of the drum 1 which are exposed to, e.g., a laser beam are discharged to exhibit a surface potential $V_R$ (approx. +100 V). Besides the power source E1 shown in FIG. 5, a power source E2 having a voltage e2 a little power than the potential $V_O$ of the drum 1 and higher than $V_R$ is used to form a smoky layer of the toner 2 over the microelectrodes 8*a* and 8*b*. FIG. 6 shows the relationships between these voltages and the potential distribution Px on the drum 1. The positively charged toner is attracted to the drum 1 in exposed regions A of low potential, and repelled and returned to the microelectrodes in unexposed regions B of high potential. These actions are indicated by arrows attached to symbols ⊕ representing the toner 2, as shown in FIGS. 5 and 6. During the actions, the toner 2 is caused to form the quivering smoky layer over electrodes 8*a* and 8*b*, by the voltage e1 applied in a pulsative manner. As a result, the toner 2 is allowed to move smoothly by the electric field of the electrostatic latent image and the bias voltage e2. Thus, it is possible to obtain finer images of improved quality and to execute inversion for development in an electric field of low magnitude. The voltage e2 need have a value such that $|e2-V_R|$ is great enough to fly the toner 2 to the drum 1. Normally, $|e2-V_R|$ needs be 400 to 500 V or more. The voltage e1 need only have a value such that the toner 2 can form the smoky layer over the microelectrodes, ranging from 200 to 500 V.

The developing operation of the developing apparatus, according to the first embodiment constructed in this manner, may be described as follows.

The developing roll 8 is rotated in the counterclockwise direction of FIG. 2 by the drive mechanism 19. As the developing roller 8 rotates in this manner, the toner 2 in the hopper 9 is regulated in layer thickness by the elastic blade 10, charged by friction with the surface of the developing roll 8, and carried out on the surface of the developing roll 8 from the hopper 9. The holding force of the charged toner 2 on the surface of the developing roll 8 may be considered to be the aformentioned reflected image force. Thus, as the developing roll 8 rotates, the toner 2 is fed to the developing region. The microelectrodes 8*a* and 8*b* of the developing roll 8, having reached the developing region, are impressed with voltage by the pair of electrode blades 17*a* and 17*b*, and the toner 2 is flown in accordance with the aforesaid process. In other words, the toner 2 carried on the developing roll 8 is flown the moment it reaches the developing region, where the smoky layer of the toner 2 is formed. Flown in this manner, the toner 2 develops the electrostatic latent image on the drum 1 in accordance with the aforementioned developing process.

Thus, the drum 1 faces the positions of contact between the electrode blades 17*a*, 17*b* for voltage supply and the shaft portions 21*a*, 21*b* connected with the microelectrodes 8n of the developng roller 8. Accordingly, the smoky layer of toner is formed only in the developing region, so that the toner is effectively prevented from scattering.

Since vibration is applied directly to the toner 2, the toner layer can easily be, made uniform in thickness. Accordingly, the elastic blade 10 as the regulating means for the toner supply requires only relatively low accuracy. Conventionally, the toner layer is charged unevenly to cause uneven imaging if it is thicker than the thickness of a monolayer (or the diameter of a single toner particle). Thus, it has conventionally been impossible to obtain a satisfactory image density with use of a relatively thick toner layer. According to the first embodiment, however, the charging efficiency of the toner is so high that a high-density, fog-free image can be obtained even though the toner layer is several times as thick as the toner particle diameter. Voltages of various composite waveforms can be scanned irrespectively of the intervals between the microelectrodes, the way of impressing voltage among a plurality of microelectrodes, and the scanning method.

It is to be understood that the present invention is not limited to the arrangement of the first embodiment described above, and that various changes and modifications may be effected therein by one skilled in the art, without departing from the scope or spirit of the invention.

Various alternative embodiments of the invention will now be described. In the description to follow, like reference numerals are used to designate like portions included in the first embodiment described above.

In the first embodiment, the developing roll 8 is rotatable, and each electrode blade 17*a* or 17*b* is so designed as to touch a single microelectrode 8*a* or 8*b* at a time. However, the present invention is not limited to this arrangement. As in a second embodiment shown in FIG. 7, for example, the developing roll 8 may be stationary with all the microelectrodes $8_1$ to $8_n$ connected to terminals S1 to Sn, respectively. As a voltage impressing portion is wavily moved between the terminals S1 to Sn connected to the microelectrodes 8*n* at a speed of several millimeters per second, the toner 2 is fed in the traveling direction of the voltage (indicated by thick arrow in FIG. 7), forming a smoky layer d1 with an estimated thickness of approximately 10 to 100 microns. The speed of the smoky layer d1 moving around the developing roll 8, which depends on the magnitude of the applied voltage and scanning speed, may range from several tens of millimeters to 100 millimeters per second.

Figure 8:
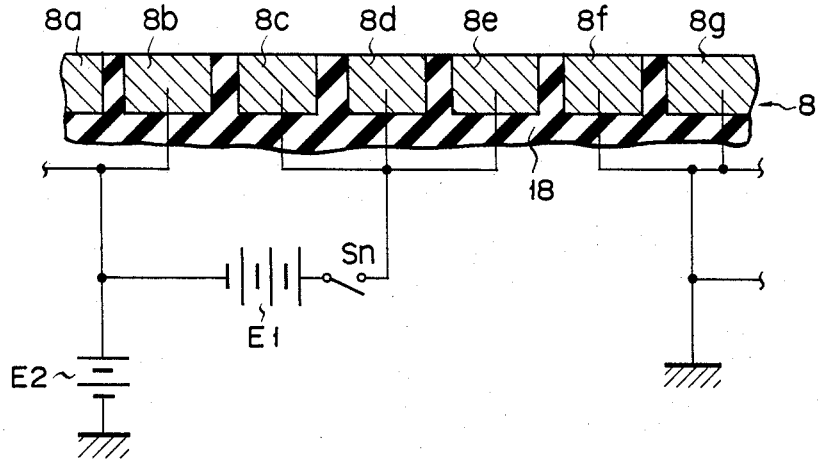
FIG. 8 is a sectional view showing a first modification of the second embodiment.
Figure 9A:
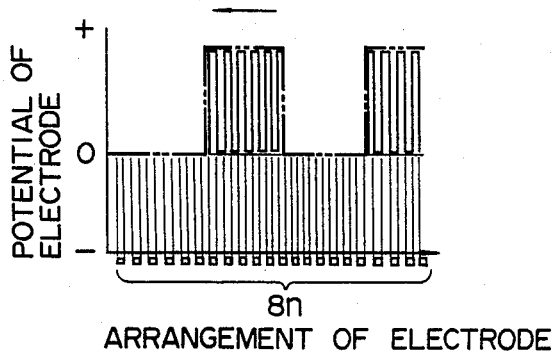
FIG. 9A is a diagram showing the potential distribution of a group of microelectrodes, attained by the structure of FIG. 8.
Figure 9B:
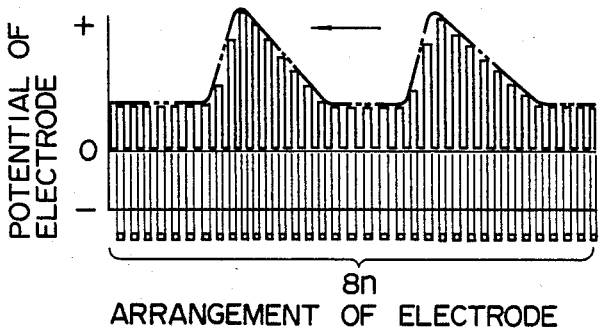
FIGS. 9B and 9C are diagrams showing second and third modifications of the second embodiment, respectively.
Figure 9C:
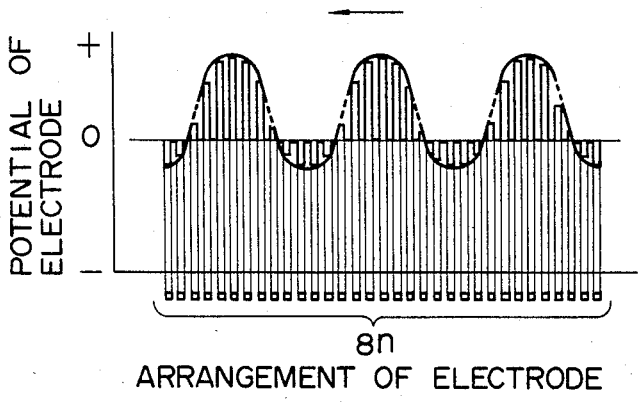

For the improved directional stability of the toner's flight, a plurality of electrodes are preferably simultaneously scanned, keeping the same potential or polarity, as shown in the first modification of FIG. 8. To attain this, the toner is slid toward the lower-potential side, by shifting the potential in such a manner that rectangular waves travel over a number of electrodes, as shown in FIG. 9A. The voltage applied pulsatively between the microelectrodes 8*n* and scanned must be prevented from causing irregular toner flight or streaks at the time of development on the drum 1. To attain this, a sufficient number of pulses are needed for the rotating speed of the drum 1, and a plurality of pulses need be applied in the developing region. The potential distribution over the microelectrodes 8*n* is not limited to the rectangular waveform, as shown in FIG. 9A, and may have a sawtooth or sinusoidal waveform, as shown in FIG. 9B or 9C.

Thus, the toner 2 forms the rotating smoky layer d1, going into and out of the hopper 9, to fly over the microelectrodes 8*n*. The greater the distance between the toner 2 and the microelectrodes 8*n*, the less the reflected image force is, as mentioned before. Therefore, the toner 2 is attracted to its facing electrostatic latent image to develop the same.

The toner 2 in the form of the smoky layer is vibrated or rotated many times on the developing roll 8. Accordingly, the frequency of contact between the toner 2 and the surface of the developing roll 8 is greatly increased as compared with the case of the first embodiment in which the contact is made only once. Thus, according to the second embodiment, there is no possibility of uneven charging.

It is to be understood that the vibration may prevent the toner 2 from cohering.

According to the second embodiment, satisfactory images may be produced under the following conditions:

(1) A selenium-tellurium film, which is 60 microns in thickness, is used as the photosensitive layer, and the drum is charged to +700 V and rotated at a peripheral speed of 80 mm/sec.

(2) The gap between the drum and the developing roll is adjusted to 500 microns (allowable range: 100 to 600 microns).

(3) A voltage of −300 V, with a period of 1.5 milliseconds, is scanned between aluminum microelectrodes arranged at a pitch of 2 units/mm on the developing roll.

(4) The toner used has particle diameter of 13.5 microns (50% average), and the charging potential of the toner on the drum is −80 V.

(5) The toner layer thickness is adjusted to about 30 microns.

An imaging test conducted under the above conditions, revealed that a high-resolution image with an image density of 1.2 or more was produced. Under the conventional condition that the image is developed without forming the smoky layer of toner, the image density in solid image regions is substantially zero, leaving outlines barely visible. By way of contrast, the conditions stated above produce excellent results. Thus, it is possible to use for the photosensitive layer organic photosensitive materials and zinc-oxide photosensitive materials which have a low withstand voltage and can be charged to at most 600 to 700 V. As a result, a developing apparatus which may practically employ color toners for multicolor development may be provided.

In the first embodiment, the electric field for the toner's flight is not applied to the toner until the toner reaches the developing region facing the drum. In the second embodiment, however, flat, microscopic electric fields are formed all over the developing roll to fly the toner. Thus, the aforementioned various effects can be obtained.

Figure 10A:
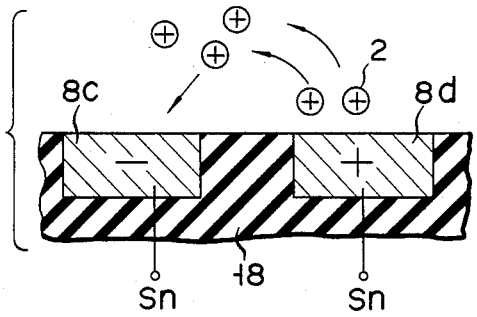
FIGS. 10A and 10B are extractive sectional views showing part of a developing roll used in a developing apparatus of a third embodiment according to the invention.
Figure 10B:
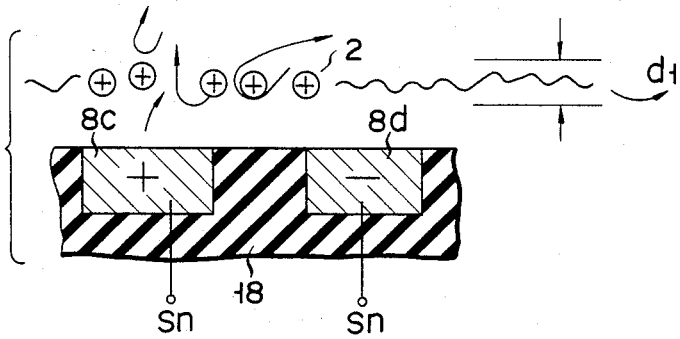

Instead of moving the position of voltage impression, the voltage may be impressed at random on the terminals S1 to Sn, in such a way as to move the toner 2 without directivity, as shown as the third embodiment of FIGS. 10A and 10B. Thus, the smoky layer of toner is formed all over. Here the "random" impression implies repetition of irregular impression as well as solely irregular impression. In this case, the toner is not electrically moved. Therefore, the developing roll 8 is rotated to feed the toner for development, so that the developing speed is prevented from being restricted by the reduction of the moving speed of the toner based on the electrical capacity.

In randomly producing the smoky layer of a toner, phase control is performed in the following manner. As shown in FIG. 10A, a toner particle leaving a microelectrode 8*d* of positive polarity at time t1 as shown in FIG. 10A is attracted to an adjacent microelectrode 8*c* of negative polarity at time t2. At time t2, the phase is changed by scanning to change the polarity of the microelectrode 8*c* to positive. Thus, the microelectrode 8*c* shares the polarity with the toner, so that the toner is repelled by the microelectrode 8*c*, and stays in the air to form a smoky or cloudy layer. In this manner, the development in the electric field of the electrostatic latent image is facilitated. In such a developing mode, the image on the drum 1 can be charged at a lower potential for development. Actually, however, the toner moves at random to form a thick layer of turbulent flow or smoke, depending on the charges thereon, variations in particle size, etc.

The materials used in the present invention may be described as follows. In selecting the materials, the frictional charging capability between the toner 2 and the developing roll 8, especially the microelectrodes 8*n* thereof, is the first to be considered. In this case, the same circumstances for the combination of carrier and toner in a two-component developing agent should be taken into consideration. The material for the developing roll 8 need be able to keep a stable amount of charges thereon. The material used in the two-component developing agent may be used directly for the toner. The amount of additives (dyes and pigments, such as nigrosine) for the control of charge amount and polarity need be adjusted in accordance with the frictional charging capability between the toner and the material used for the microelectrodes of the developing roll 8, such as aluminum, Alumite, copper, brass, tin, or chromium-plated versions of these materials. Presently, it is difficult to estimate the charge amount, so that trials and errors are needed for each combination of materials. The toner 2 is expected to have good mechanical fluidity. Therefore, it is advisable to spray the toner in hot air to sphere the toner particles or to add silica powder to the toner. Also; in this embodiment, the optimum charge amount of the tonr should satisfy the equation given in the description of the prior art. By adjusting the distance between each two adjacent microelectrodes to an arbitrary value smaller than the distance D between the drum 1 and the developing roll 8, however, the toner can be flown with use of a voltage lower than the voltage to be applied between the drum 1 and the developing roll 8. The flied toner weakens its reflected image force and is easily attracted to the electrostatic latent image. The constraining force of a toner particle flying, e.g., 20 microns above the surface of the developing roll 8 is estimated as one sixteenth that of a nonflying toner particle.

Those toner particles which have not reached the electrostatic latent imag will be attracted, the next moment, to another electrode to be returned to the developing roll 8, without being scattered out of the apparatus.

The method of toner supply is not limited to the methods used in the first and second embodiments. For example, the toner may be separately fed onto the developing roll 8 by the magnetic brush process or cascade process using the two-component developing agent, as in the prior art apparatuses. According to these processes, the toner supplied is pre-charged. Therefore, these processes may suitably be applied to an improvement of the developing system of the first embodiment which uses low toner charging efficiency, as described in connection with FIG. 3.

The developing roll 8 need not always be cylindrical and may, for example, by belt-shaped. Instead of being linear, moreover, each of the microelectrodes 8*n* may be spiral. Alternatively, the microelectrodes may be formed into minute projections arranged at regular intervals of several microns to several tens of microns so that the flying capability and dispersibility of the toner are improved. The bias voltage applied between the microelectrodes 8*n* is not limited to a DC voltage. Theoretically, the same effect can no doubt be obtained with use of an AC voltage for that purpose, as long as phase control is executed properly.

In the foregoing embodiments, the toner is an insulator. If the toner is of lower resistance, however, injection of charges from an electrode into the toner is easier. Thus, the toner always has the same polarity as the electrode, and enjoys as easy condition to fly. Hereupon, it is generally known that a low-resistance toner has a problem related to image transfer form the drum. However, the low-resistance toner may be avaiable if a pressure transfer process is used.

The combination of the polarity of the toner and that of the bias voltage to be applied between the microelectrocdes 8*n* is not limited to the combination used in the aforementioned embodiments. It is naturally possible to apply the voltage of such a value as to prevent fog or increase the magnitude of the electric field between the toner and the drum, thereby accelerating the flight of the toner as required. A means for providing a potential difference between the microelectrodes 8*n* is essential to the formation of a spontaneous smoky layer of the toner 2. Thus, the bias voltage may additionally be biased positively or negatively without departing from the scope of the present invention. Accordingly, various objects may be achieved by effecting modifications, such as first and second modifications of the first embodiment of FIG. 5, as shown in FIGS. 11 and 12.

In FIG. 7, the switches Sn are used for the electrical switching means. However, the switches Sn are shown for the ease of illustration of the toner's flight. Actually, for example, a scanning electric circuit combining shift registers and driver circuits is used for the switching means, as shown in FIG. 13. According to this arrangement, the impression time required is controlled, and power supply is achieved so that the phase of voltage changes in succession without repeating steady-state voltage impression on a specified electrode.

Figure 14:
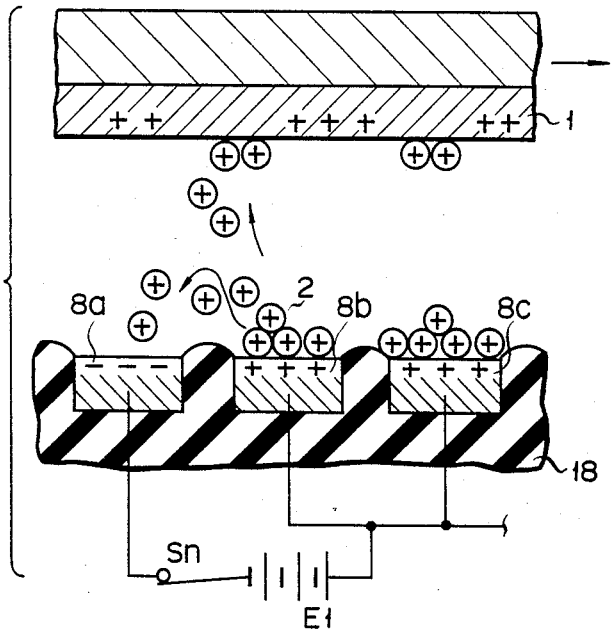
FIGS. 14 and 15 are sectional views showing a fourth modification of the second embodiment.
Figure 15:
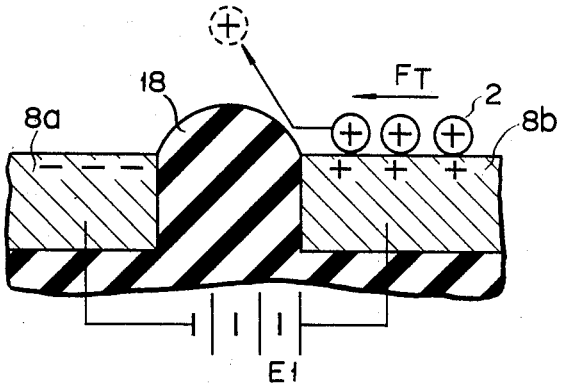

The dielectric member 18 may be so formed that its exposed surface portions between the microelectrodes 8*n* are arcuate and project from the surfaces of the electrodes 8*n*, as shown in a modification of the second embodiment of FIGS. 14 and 15.

According to this embodiment, as the toner 2 is moved horizontally by a force $F_T$ produced by voltage impression, it is scattered upward, as indicated by an arrow, being reflected by the lateral face of each exposed surface portion of the dielectric member 18.

Thus, the charging potential of the drum 1 for development may be lowered, improving the life performance of the drum 1.

Figure 16:
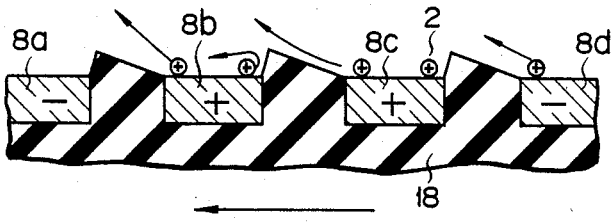
FIG. 16 is a sectional view showing a fifth modification of the second embodiment.

As shown in another modification of FIG. 16, each of the exposed surface portions of the dielectric member 18 may be upwardly tapered in the moving direction of the toner 2. In this modification, the upright surface of each tapered portion can restrain the toner 2 from flowing in the reverse direction, thereby improving the stability of the toner feed.

The embodiments described above perform reversal development. Nonetheless, they can perform ordinary developing as well, exactly in the same manner as explained above. In other words, the invention is not limited to the embodiments.

According to the present invention, as described above, a potential difference is applied between a group of electordes of a developing agent feeder, so that a developing agent files between the electrodes. Accordingly, a reflected image force produced between the developing agent and the feeder can greatly be reduced, so that the developing agent can easily be attracted to a developing region. Thus, an electrostatic latent image can be developed at a relatively low potential, and many organic photosensitive materials and zinc-oxide photosensitive materials with low withstand voltage may be used as a photosensitiave layer. Since the developing agent rotates or vibrates on the electrodes of the feeder, the efficiency of contact between the developing agent and the electrodes is improved to permit uniform charging of the developing agent, and to prevent the developing agent from cohering. Thus, a high-quality image can be produced.

What is claimed is:

1. A developing apparatus operatively associated with an electrostatic latent image forming surface of an image carrier for supplying the electrostatic latent image forming surface with developer particles charged with a predetermined polarity to thereby develop an electrostatic latent image formed on the electrostatic latent image forming surface, said developing apparatus comprising:

a substrate having a portion in confronting relationship with said electrostatic latent image forming surface to establish a space between said portion and said electrostatic latent image forming surface, said charged developer particles being transferrable from said portion to said electrostatic latent image forming surface through said space;

at least one pair of adjacent spaced-apart electrodes formed on said substrate portion, each said electrode having a surface facing the electrostatic latent image forming surface; and voltage impressing means for impressing said at least one pair of adjacent electrodes with a voltage of sufficient magnitude to generate an electric field which repels charged developer particles away from said surface of one of said pair of electrodes into said space, wherein certain ones of said repelled charged developer particles are attracted by said electrostatic latent image forming surface while other ones of said repelled charged developer particles are transferred in said space between said one and the other of said pair of electrodes.

2. The developing apparatus according to claim 1, wherein said image carrier is moveable in one direction, and wherein each of said electrodes extends in a direction perpendicular to said one direction.

3. The developing apparatus according to claim 2, further comprising mounting means for mounting said substrate for movement relative to said one direction to sequentially bring the surfaces of said plural pairs of electrodes into confronting relationship with said elecrostatic latent image forming surface.

4. The developing apparatus according to claim 3, wherein said mounting means includes drive means for moving the substrate in said one direction.

5. The developing apparatus according to claim 4, wherein said voltage impressing means includes first and second feeder blade means, said first feeder blade means for sequentially contacting said one of said pair of electrodes, and said second feeder blade means for sequentially contacting said other of said pair of electrodes as said substrate is moved in said one direction.

6. The developing apparatus according to claim 4, wherein said voltage impressing means includes means for randomly applying voltage to all of said electrodes.

7. The developing apparatus according to claim 2, wherein said substrate is stationary.

8. The developing apparatus according to claim 7, wherein said voltage applying means includes switching means connected to all said electrodes, for intermittently applying voltage to said electrodes.

9. The developing apparatus according to claim 8, wherein said voltage applying means includes means for impressing one pair of said electrodes selected among said plurality of electrodes with a traveling-wave voltage having a predetermined voltage waveform and for changing the voltage waveform with the passage of time.

10. The developing appartaus according to claim 9, wherein said voltage waveform is square.

11. The developing apparatus according to claim 9, wherein said voltage waveform is sinusoidal.

12. The developing apparatus according to claim 9, wherein said voltage waveform is sawtoothed.

13. The developing apparatus according to claim 2, wherein said substrate between adjacent ones of said electrodes define an outer surface flush with said surfaces of said electrodes.

14. The developing apparatus according to claim 2, wherein said substrate between the adjacent electrodes includes means defining an outer surface projected above the surfaces of the electrodes, said outer surface defining means for upwardly deflecting said repelled charged particles into said space.

15. The developing apparatus according to claim 14, wherein said outer surface defining means defines a smooth curved surface.

16. The developing apparatus according to claim 14, wherein said outer surface defining means defines sawtoothed surfaces.

17. The developing apparatus as in claim 14 wherein said surface defining means defines (a) a first surface for upwardly deflecting said repelled charged particles into said space and (b) a second surface, downstream of said first surface relative to said one direction, for preventing the return of charged particles on the surface of said other electrode to the surface of said one electrode.

18. The developing apparatus as in claim 1 wherein plural pairs of electrodes are formed on said substrate, and wherein said voltage impressing means impresses at least one pair of said electrodes among said plural pairs of electrodes with said voltage of sufficient magnitude.

* * * * *